US012276476B1

(12) United States Patent
Riley

(10) Patent No.: US 12,276,476 B1
(45) Date of Patent: Apr. 15, 2025

(54) AUTOMATICALLY-RELOADING AIR GUNS AND METHODS OF OPERATION

(71) Applicant: Louis F. Riley, Conway, AR (US)

(72) Inventor: Louis F. Riley, Conway, AR (US)

( * ) Notice: Subject to any disclaimer, the term of this patent is extended or adjusted under 35 U.S.C. 154(b) by 0 days.

(21) Appl. No.: 18/523,669

(22) Filed: Nov. 29, 2023

(51) Int. Cl.
*F41B 11/73* (2013.01)
*F41B 11/55* (2013.01)
*F41B 11/643* (2013.01)

(52) U.S. Cl.
CPC ..... *F41B 11/73* (2013.01); *F41B 11/55* (2013.01); *F41B 11/643* (2013.01)

(58) Field of Classification Search
CPC ..... F41B 11/55; F41B 11/643; F41B 11/73
See application file for complete search history.

(56) References Cited

U.S. PATENT DOCUMENTS 945,328 A * 1/1910 Johnson ..... F41A 9/53 89/162
3,236,222 A 2/1966 Pitcher
3,921,614 A 11/1975 Fogelgren
4,531,503 A 7/1985 Shepherd
5,906,191 A 5/1999 Wonisch et al.
6,161,322 A * 12/2000 Liebenberg ..... F41A 9/53 42/1.05
6,493,977 B1 * 12/2002 Liebenberg ..... F41A 9/53 42/1.05
6,662,797 B1 * 12/2003 Freeman ..... F41A 21/20 124/83
7,353,815 B2 4/2008 Wei
7,398,776 B2 7/2008 Casas Salva
D611,115 S 3/2010 Pennington
7,757,682 B2 7/2010 Kaminker et al.
7,784,454 B2 8/2010 Tiberius et al.
7,921,838 B2 4/2011 Tippmann, Jr. et al.
8,011,355 B2 9/2011 Kawashima
8,203,821 B2 6/2012 Hsieh et al.
8,430,086 B2 4/2013 Tippmann, Jr. et al.
8,479,432 B2 7/2013 Braun
8,485,858 B2 7/2013 Wei
8,550,062 B2 10/2013 Maeda
8,602,784 B2 12/2013 Dvorak
8,726,895 B2 5/2014 Tippmann, Jr. et al.
9,194,647 B2 11/2015 Maeda
9,200,865 B2 12/2015 Maeda
9,291,420 B1 3/2016 Jensen et al.
9,395,146 B2 7/2016 Tippman, Jr. et al.
(Continued)

*Primary Examiner* — Bret Hayes
(74) *Attorney, Agent, or Firm* — Hartman Global IP Law; Gary M. Hartman; Domenica N. S. Hartman

(57) ABSTRACT

Automatically-reloading air guns and methods associated therewith. The automatically-reloading air gun includes a barrel fixedly carried by a frame, and a vent aperture in fluid communication with a firing chamber. Actuation of a release mechanism from an engaged position to a disengaged position allows a charge of compressed gas to slide a firing piston forward to force a projectile in the firing chamber into the breach end of the barrel. The compressed gas can exhaust out of the vent aperture from the firing chamber when the firing piston is in the extended position. The return spring slides the firing piston rearwardly to the retracted position after the compressed gas has exhausted from the firing chamber to automatically reload a new projectile into the firing chamber.

14 Claims, 3 Drawing Sheets

(56) References Cited

U.S. PATENT DOCUMENTS

| | | | | |
|---|---|---|---|---|
| 9,752,846 | B1 * | 9/2017 | Kenaley | F41B 11/71 |
| 11,209,237 | B2 | 12/2021 | Quek | |
| 11,768,053 | B1 * | 9/2023 | Edelman | F41B 11/62 124/56 |
| 2003/0106545 | A1 | 6/2003 | Verini | |
| 2006/0191525 | A1 | 8/2006 | Dai | |
| 2007/0151551 | A1 | 7/2007 | Verini | |
| 2007/0235016 | A1 * | 10/2007 | Moritz | F41B 11/723 124/72 |
| 2010/0126486 | A1 | 5/2010 | Halmone et al. | |
| 2013/0055996 | A1 | 3/2013 | Perry | |
| 2013/0220294 | A1 | 8/2013 | Tippmann, Jr. et al. | |
| 2021/0055082 | A1 | 2/2021 | Geisler et al. | |
| 2021/0108879 | A1 | 4/2021 | Clemons et al. | |
| 2021/0381797 | A1 | 12/2021 | Buys | |

* cited by examiner

AUTOMATICALLY-RELOADING AIR GUNS AND METHODS OF OPERATION

BACKGROUND OF THE INVENTION

The invention generally relates to automatically-reloading air guns and their operation, and particularly to automatically-reloading air guns that are operable with a fixed barrel and methods for their operation.

Air guns typically shoot a projectile, such as a pepper ball, paintball, BB, or other generally similar projectile (sometimes referred to herein as a "round"). The projectile is fired from a chamber at a rear end of a barrel, through the barrel, and then out the front end of the barrel by means of releasing an amount of a compressed gas to propel the projectile through the barrel. The term "air gun" is commonly used to refer to a gun that propels a projectile by releasing an amount of compressed air or carbon dioxide ($CO_2$), but other compressible gases may be used and the term "air" will sometimes be used herein simply as a matter of convenience. The compressed air is typically released by actuating a trigger assembly, such as by pulling a finger trigger to "fire" the projectile from the air gun. In some conventional air guns, when the gun is fired, the barrel cycles ("barrel cycling") by moving linearly forward due to the pressure of the released gas ("blowback") and then returns backward due to the force of a return spring. This barrel cycling is intentionally used and designed to load the next round from a magazine or other supply of rounds so as to provide an automatic reloading action, leading to such guns sometimes being referred to as automatically-reloading air guns. However, such barrel cycling reduces the accuracy of the gun, especially when a fired round is immediately followed by a second round. Accuracy is particularly important if the projectile is a pepper ball being fired in self-defense at an aggressor.

Therefore, it would be desirable to have an air gun that can provide an automatic reloading action that does not utilize a recycling barrel to improve the accuracy of the gun.

BRIEF SUMMARY OF THE INVENTION

The intent of this section of the specification is to briefly indicate the nature and substance of the invention, as opposed to an exhaustive statement of all subject matter and aspects of the invention. Therefore, while this section identifies subject matter recited in the claims, additional subject matter and aspects relating to the invention are set forth in other sections of the specification, particularly the detailed description, as well as any drawings.

The present invention provides, but is not limited to, automatically-reloading air guns to methods for their operation, including firing and using such an automatically-reloading air gun.

According to a nonlimiting aspect, an automatically-reloading air gun includes a frame, a firing chamber disposed in the frame to receive a projectile, a firing piston slidably carried by the frame and disposed at a rear end of the firing chamber, a release mechanism shiftable between an engaged position that retains the firing piston in a retracted position behind the firing chamber and a disengaged position that allows the firing piston to move forwardly into the firing chamber to an extended position, a return spring that urges the firing piston toward the retracted position, a barrel fixedly carried by the frame at a front end of the firing chamber, and a vent aperture through the frame and in fluid communication with the firing chamber. Actuation of the release mechanism from the engaged position to the disengaged position allows a charge of a compressed gas behind the firing piston to slide the firing piston forward into the firing chamber to force a projectile in the firing chamber into the barrel. The compressed gas exhausts out of the vent aperture from the firing chamber when the firing piston is in the extended position. The return spring slides the firing piston rearwardly to the retracted position after the compressed gas has been sufficiently exhausted from the firing chamber to enable a new projectile to be automatically reloaded into the firing chamber.

According to another nonlimiting aspect, a method of firing the automatically-reloading described above includes providing a charge of a compressed gas behind the firing piston, shifting the release mechanism from the engaged position to the disengaged position to allow the charge of compressed air to force the firing piston forward into the firing chamber without sliding the barrel relative to the frame, exhausting at least a portion of the compressed air from the firing chamber through the vent aperture when the firing piston is disposed in the extended position, and sliding the firing piston rearwardly to the retracted position with the return spring after at least the portion of the compressed air has been exhausted through the vent aperture.

According to yet another nonlimiting aspect, a method of using the automatically-reloading described above includes visually determining if a projectile is disposed in the firing chamber by looking through the vent aperture.

Technical aspects of air guns and methods having features as described above preferably include the ability to provide a more accurate system for firing pepper balls and/or other projectiles than conventional air guns.

These and other aspects, arrangements, features, and/or technical effects will become apparent upon detailed inspection of the figures and the following description.

DETAILED DESCRIPTION OF THE INVENTION

Figure 1:
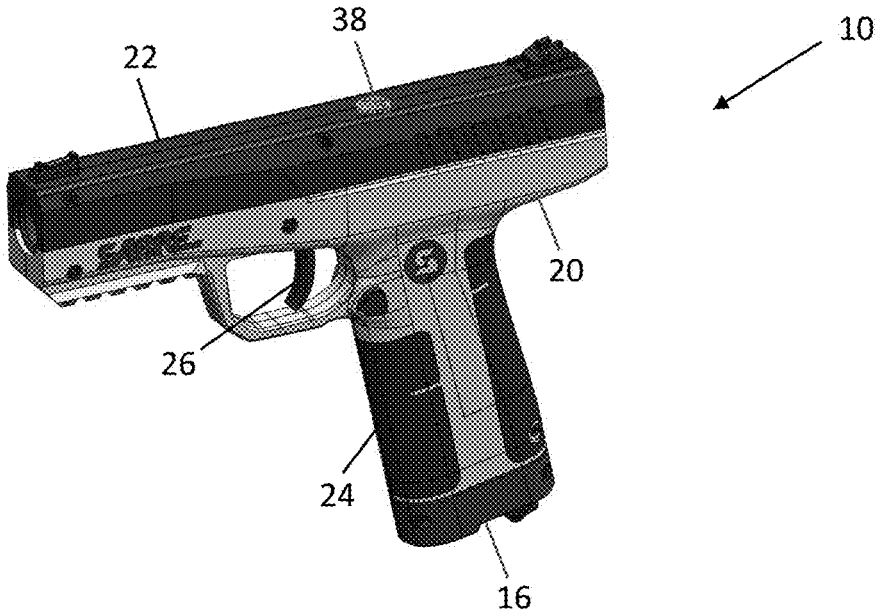
FIG. 1 is a perspective view of an air gun according to a nonlimiting embodiment of the invention.
Figure 2:
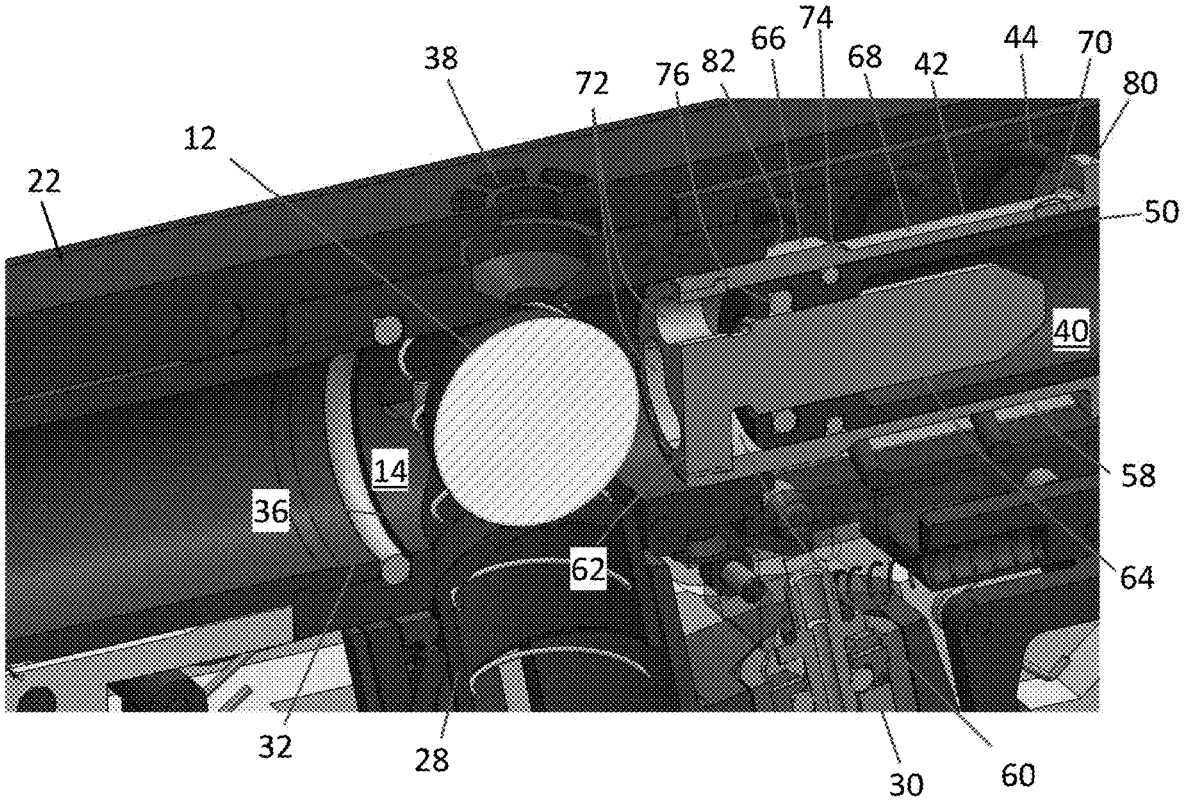
FIG. 2 is an enlarged perspective cross-sectional view of the air gun showing a firing chamber located at an end of a barrel, a breach end of the barrel, and a front end of a firing piston.

The intended purpose of the following detailed description of the invention and the phraseology and terminology employed therein is to describe what is shown in the drawings, which include the depiction of one or more nonlimiting embodiments of the invention, and to describe certain but not all aspects of what is depicted in the drawings. The following detailed description also identifies certain but not all alternatives of the embodiment(s) depicted in the drawings. As nonlimiting examples, the invention encompasses additional or alternative embodiments in which one or more features or aspects shown and/or described as part of a particular embodiment could be eliminated, and also encompasses additional or alternative embodiments that combine two or more features or aspects shown and/or described as part of different embodiments. Therefore, the appended claims, and not the detailed description, are intended to recite what at least provisionally are believed to be aspects of the invention, including certain but not necessarily all of the aspects and alternatives described in the detailed description.

Although the invention will be described hereinafter in reference to an air gun in the form of a hand pistol shown in the drawings, it will be appreciated that the teachings of the invention are more generally applicable to a variety of types of air guns that operate to use a supply of compressed gas of any suitable type, such as but not limited to air, carbon dioxide ($CO_2$), nitrogen, other (non-ignited) gases and/or mixtures thereof, to forcefully eject a projectile. As such, the term "air gun" and "air" as used herein typically refers to any compressible gas suitable for use in the air gun, not just atmospheric air (e.g., the atmospheric mixture of 78% nitrogen, 21% oxygen, and 1% argon and other trace gases and substances, etc.), unless clearly identified otherwise. Similarly, the form of the air gun is not limited to a semi-automatic hand pistol form factor, but may be other styles of guns, such as long guns, other styles of handguns, nail guns, and paint ball guns, by way of non-limiting examples. Further, while the projectiles referenced in the following description are pepper-balls, other types of projectiles, such as paint balls, water balls, nails, BBs and/or darts, by way of non-limiting examples, may be used.

To facilitate the description provided below of the embodiment(s) represented in the drawings, relative terms, including but not limited to, "proximal," "distal," "anterior," "posterior," "vertical," "horizontal," "lateral," "front," "rear," "side," "forward," "rearward," "top," "bottom," "upper," "lower," "above," "below," "right," "left," etc., may be used in reference to the orientation of the air gun during its use and/or as represented in the drawings. All such relative terms are useful to describe the illustrated embodiment(s) but should not be otherwise interpreted as limiting the scope of the invention.

As used herein the terms "a" and "an" to introduce a feature are used as open-ended, inclusive terms to refer to at least one, or one or more of the features, and are not limited to only one such feature unless otherwise expressly indicated. Similarly, use of the term "the" in reference to a feature previously introduced using the term "a" or "an" does not thereafter limit the feature to only a single instance of such feature unless otherwise expressly indicated.

Turning now to the nonlimiting embodiment represented in the drawings, FIGS. 1-6 depict an automatically-reloading air gun 10 exemplifying certain principles of the invention. In this example, the air gun 10 is configured to "fire" (that is, to propel forcefully out the front end of the barrel) projectiles 12, represented in the drawings as pepper balls. A pepper ball is a projectile that is or comprises a capsule that contains a pepper substance that acts as an irritant for non-lethal use against an attacker or other intended target. The air gun 10 preferably is configured to eject such a projectile 12 with a force and/or muzzle velocity sufficient to break open the capsule and thereby disperse the pepper substance therein when the pepper ball impacts its intended target. As explained in more detail hereinafter, a unique feature of the air gun 10 allows for automatic reloading of the firing chamber 14 from a magazine 16 without the barrel 18 being cycled axially forward and backward with each firing of a projectile 12. Rather, the barrel 18 remains in a fixed position relative to the frame 20 of the air gun 10, i.e., the barrel 18 does not more relative the air gun frame 20 during or after a projectile 12 is fired. This capability improves the accuracy of the air gun 10 relative to conventional automatic reloading air guns in which the barrel must be cycled axially to reload the firing chamber, as such movement can disrupt and interfere with the user's ability to maintain the gun properly aimed at the intended target.

As best seen in FIG. 1, the frame 20 is the general outer shape and form of a standard semiautomatic pistol, including an upper portion 22 in which the firing chamber 14 and the barrel 18 are disposed, and a grip 24 extending downwardly at a rearward angle from a rear portion of the upper portion 22. A finger trigger 26 extends downwardly from the upper portion 22 in front of the grip 24 and is shown as being partially surrounded by a trigger guard.

Figure 3:
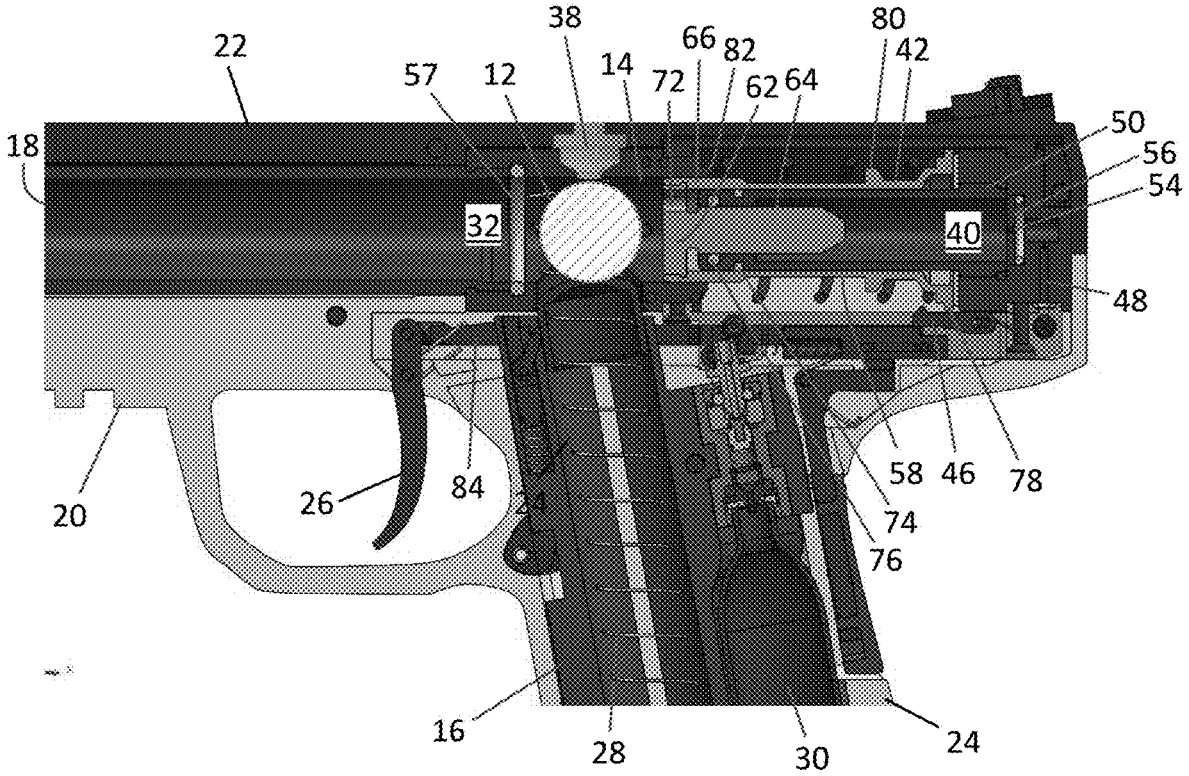
FIG. 3 is a cross-sectional view of the air gun along the axis of the barrel with a compression chamber in an unpressurized state and the firing piston in a completely retracted position.

As best seen in FIGS. 1 and 3, the magazine 16 can be inserted and locked into its operative position inside the grip 24. The magazine 16 holds a supply of projectiles 12 and includes a feeder mechanism 28 for automatically feeding the projectiles 12 into the firing chamber 14, for example with a spring and follower assembly, when so inserted in the grip 24. The magazine 16 in this example is also shown as holding a pressurized gas canister 30 that is fluidly/pneumatically coupled to the firing mechanism 28 for firing the projectile 12 as explained in hereinafter. The magazine 16 and a safety mechanism may be configured as described in co-pending U.S. patent application Ser. No. 18/060,893 the contents of which are incorporated herein by reference. However, the present invention is not limited to the specific magazine design illustrated here, and other magazine designs configured to automatically feed projectiles into the firing chamber 14 through a lateral opening into the firing chamber 14 (e.g., radially with respect to the axis of the barrel 18) could be used.

The barrel 18, firing chamber 14, and the firing mechanism 28 are disposed substantially inside the upper portion 22 of the frame 20. The firing chamber 14 is shown as disposed directly above the grip 24, and the barrel 18 is disposed forward of the firing chamber 14 with its breach end 32 disposed at a front end 34 of the firing chamber 14 and its front end (i.e., muzzle end) directed out the front end of the upper portion 22 of the frame 20. The barrel 18 is secured within the upper portion 22 of the frame 20 by any suitable mechanism such that the barrel 18 is substantially fixed such that it does not intentionally move relative to the frame 20 when the air gun 10 is fired. In the drawings, the firing chamber 14 is formed by a length of circular tubing sized to receive the projectile 12 within its diameter and fixed inside the frame 20. In this example, the front end 34 of the firing chamber 14 is coupled to the breach end 32 of the barrel 18, and a pneumatic seal 57, such as an O-ring, is disposed between the breach end 32 and the firing chamber 14 to prevent air from escaping at the interface therebetween. The firing chamber 14 may be secured to the breach end 32 of the barrel 18, for example, by a plug-and-socket fit, a friction fit, and/or threaded coupling. Alternatively, it is within the scope of the invention that the firing chamber 14 may be integrally formed with the barrel 18 such that there is no seam or joint between the front end 34 of the firing chamber 14 and the breach end 32 of the barrel 18, or the firing chamber 14 may simply be formed by a bore defined by or otherwise inside the frame 20. A loading opening 36 extends laterally through a lower portion of the sidewall of the firing chamber 14 aligned with the feeder mechanism 28 such that the feeder mechanism 28 can force a projectile 12 from the magazine 16 laterally (relative to the axis of the barrel 18) into the firing chamber 14.

A vent aperture 38 extends through the upper portion 22 of the frame and laterally through the sidewall of the firing chamber 14. The vent aperture 38 preferably is aligned axially along the firing chamber 14 such that a user can see into the firing chamber 14 through the vent aperture 38. This allows a user to be able to visually verify whether a projectile 12 is disposed inside the firing chamber 14 by simply looking through the vent aperture 38. The drawings show the vent aperture 38 as extending through the top surface of the upper portion 22 of the frame 20 and radially downwardly through an upper portion of the sidewall of the firing chamber 14. However, the vent aperture 38 could extend into the firing chamber 14 from other angles. The vent aperture 38 is preferably sized to be substantially smaller than the diameter of a projectile 12 that is appropriately sized for the barrel 18, such that the projectile 12 cannot become lodged inside the vent aperture 38. The drawings show the vent aperture 38 is flaring outwardly from the firing chamber 14 through the frame 20 to dissipate the force of the gas exhausted (vented) therethrough from the firing chamber 14. The vent aperture 38 is shown as having an optional screen disposed across where the aperture 38 intersects the exterior surface of the frame 20 to reduce the risk of extraneous matter clogging of the vent aperture 38 and/or promote the dissipation of the force of the gas being vented through the vent aperture 38.

The firing mechanism 28 is represented as disposed immediately behind the firing chamber 14 opposite the breach end 32 of the barrel 18. The firing mechanism 28 includes a compression chamber 40, a firing piston 42, a return spring 44, and a release mechanism 46 operatively coupled with the finger trigger 26. The axes of the firing piston 42 and the firing chamber 14 are coaxial with the axis of the barrel 18.

The compression chamber 40 is pneumatically coupled with the gas canister 30 when the magazine 16 is in its operative position inside the grip 24, for example, by one or more gas conduits 48 extending from the gas canister 30 to the compression chamber 40. In this nonlimiting example, the compression chamber 40 has a generally tubular shape axially aligned with the axis of the barrel 18. The compression chamber 40 is fixedly coupled with the frame 20 by any suitable mechanism, such as threads, friction fit, snap fit detents, welds, adhesive, etc. The tubular shape of the compression chamber 40 defines a cylindrical peripheral chamber wall 50, a front end wall 52 across a front end of the peripheral chamber wall, and an inlet 54 disposed at a back end of the peripheral chamber wall 50. The inlet 54 is pneumatically coupled with the gas conduit 48 such that compressed air from the gas canister 30 can enter into the compression chamber 40 through the inlet 54. Preferably, a check valve 56 is disposed across the inlet 54 to prevent gas from flowing in reverse from the compression chamber 40 into the gas conduit 48.

The firing piston 42 is slidably mounted around the compression chamber 40 and when cycled axially slides forward and backward thereon along the axis of the barrel 18 and the firing chamber 14 in response to gas pressure inside the compression chamber 40. In this nonlimiting example, the firing piston 42 has a generally tubular shape formed by a generally cylindrical peripheral piston wall 58 that defines an inner chamber 60 and fits snugly around the outer surface of the cylindrical peripheral chamber wall 50 of the compression chamber 40. A front wall 62 is disposed across the front end of the peripheral piston wall 58. A plunger 64 extends rearwardly from a central portion of the front wall 62 back into the inner chamber 60. A radial gap is defined between the outer surface of the plunger 64 and the interior surface of the peripheral piston wall 58. The plunger 64 slidably extends through an opening 65 through the front end wall 52 of the compression chamber 40. The front end of the peripheral piston wall 58 forms a piston head 66 that is shaped complementary to an interior surface of the firing chamber 14 such that the piston head 66 forms a sliding seal with the interior surface of the firing chamber 14. A recessed groove 68 is disposed in the exterior surface of the peripheral piston wall 58 immediately rearward of the piston head 66. The recessed groove 68 extends axially rearwardly from the piston head 66 toward the rear end of the firing piston 42 and is angularly aligned about the axis of the barrel 18 with the vent aperture 38. The recessed groove 68 may extend around the entire outer periphery of the firing piston 42, or it may only extend part way around the outer periphery of the firing piston 42. In either circumstance, the recessed groove 68 is aligned such that the vent aperture 38 opens into the recessed groove 68 when the firing piston 42 is in a forward position against the breach end 32 of the barrel 18, as described hereinafter. At least one first aperture 70 extends through the peripheral piston wall 58 into the recessed groove 68. The first aperture 70 is spaced axially rearwardly from the piston head 66 such that the first aperture 70 is closed off from the inner chamber 60 by the peripheral chamber wall 50 when the firing piston 42 is in the rearwardly retracted positions shown in FIGS. 3 and 4 and the intermediate position as shown in FIG. 5, and the first aperture 70 is open to the inner chamber 60 when the firing piston 42 is in the fully extended position shown in FIG. 6. One or more second apertures 72 extend through the front wall 62 in the radial space between the plunger 64 and the peripheral piston wall 58. The second apertures 72 pneumatically connect the inner chamber 60 with the firing chamber 14. A first seal 74, such as a gasket or O-ring, forms a sliding seal between the outer surface of the peripheral chamber wall 50 and the inner surface of the peripheral piston wall 58 to form an airtight seal therebetween. A second seal 76, such as a gasket or O-ring, forms a second sliding seal between the inner radial surface of the opening 65 through the front end wall 52 of the compression chamber 40 and the outer surface of the plunger 64 to form an airtight seal therebetween. A stop member 80 is disposed on the radially exterior surface of the firing piston 42 spaced axially rearwardly from the piston head 66 an axial distance sufficient to allow the firing piston 42 to cycle forward to the extended position, and in the extended position engage a second stop member 82 that stops the forward travel of the firing piston 42 at the extended position. In this example, the second stop member 82 is formed by the rearward edge of the firing chamber 14. However, other configurations and arrangements for the first and second stop members 80 and 82 could be used.

Figure 4:
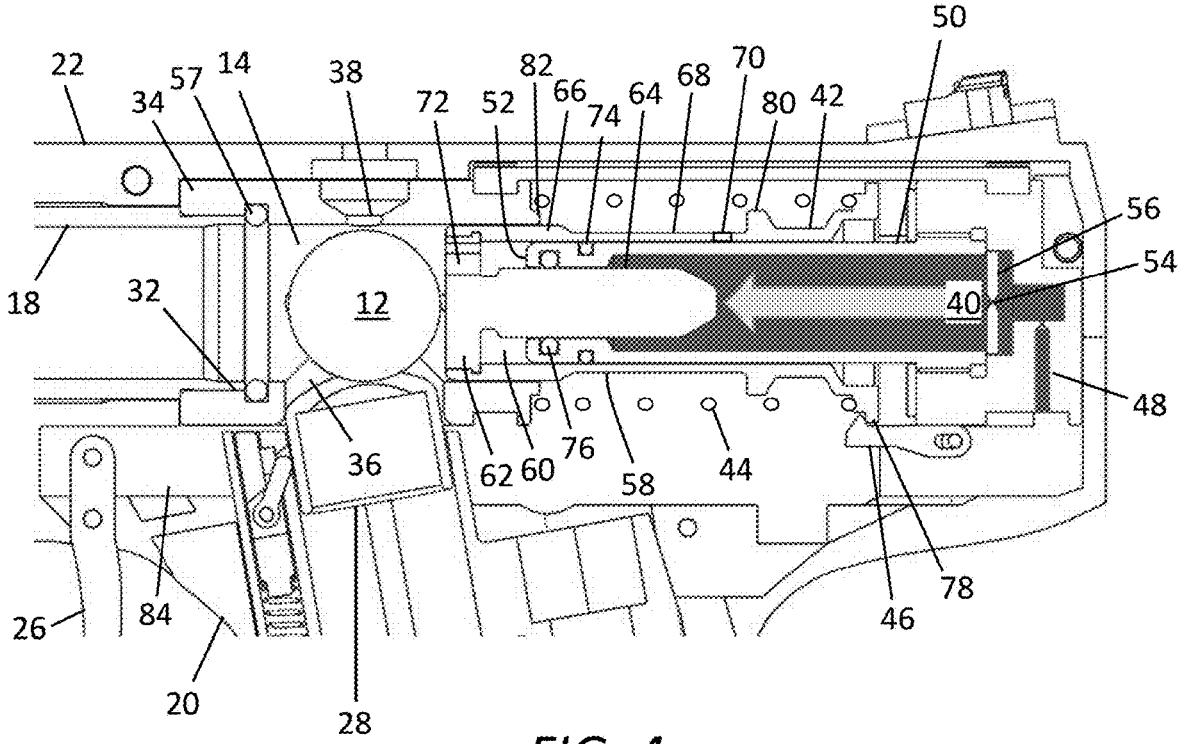
FIG. 4 is another axial cross-sectional view of the air gun with the compression chamber in a pressurized state with a release mechanism for the firing piston maintaining the firing piston in a retracted position.
Figure 5:
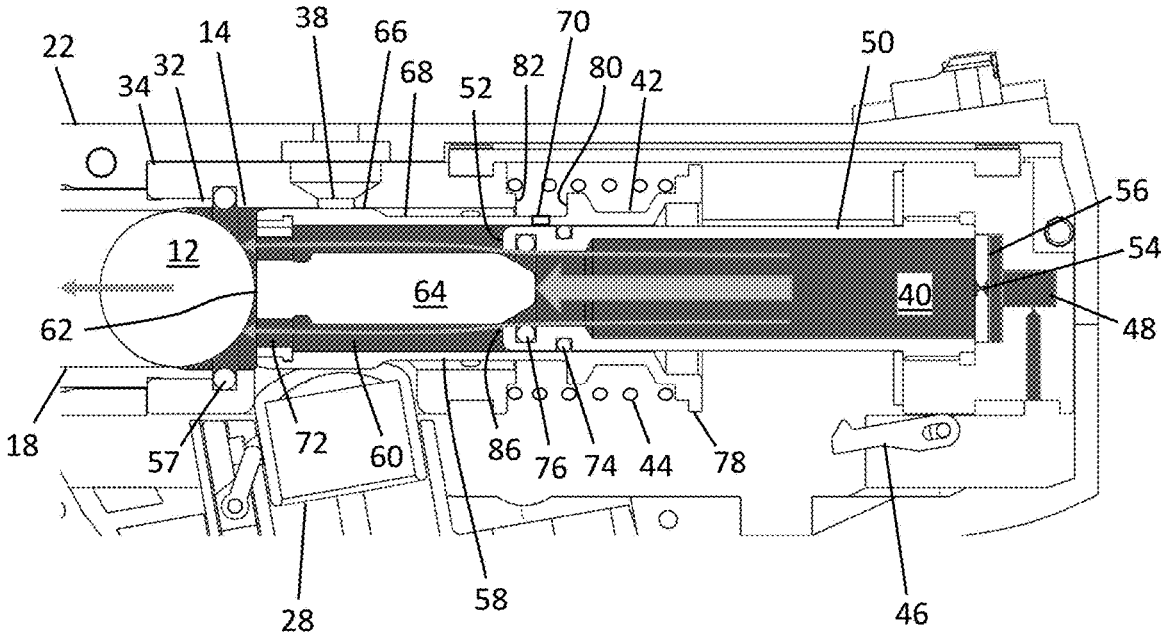
FIG. 5 is another axial cross-sectional view of the air gun with its trigger retracted, the release mechanism shifted to a disengaged position, and the firing piston in an intermediate position that is shifted forward into the firing chamber toward the breach end of the barrel.

The return spring 44 is arranged to resiliently urge the firing piston 42 toward the retracted positions shown in FIGS. 3 and 4. In the nonlimiting embodiment represented in the drawings, the return spring 44 is a coil spring disposed around the exterior of the firing piston 42 and extends axially between the rear end of the firing chamber 14 and a radial collar 78 (e.g., a flange) at the rear end of the firing piston 42. However, other configurations for the return spring 44 could be used.

The release mechanism 46 in this example is in the form of a pivotable sear that engages the radial collar 78 when the firing piston 42 is in the retracted position shown in FIG. 4; however, other configurations of release mechanisms could be implemented. The release mechanism 46 is operatively coupled to the finger trigger 26 by a linkage 84 such that the sear rotates downwardly to disengage from the radial collar 78 when the finger trigger 26 is pulled rearwardly. This downward motion of the sear disengages the release mechanism 46 from the firing piston 42, thereby allowing gas pressure inside the compression chamber 40 to overcome the force of the return spring 44 and force the firing piston 42 in a forward direction toward and through the firing chamber 14.

FIGS. 3-6 illustrate the cycling of the firing mechanism 28. FIG. 3 illustrates the position of the firing mechanism 28 with a projectile 12 disposed inside the firing chamber 14 and without a charge of compressed gas inside the compression chamber 40. The compression chamber 40 in this configuration is not fluidly connected with pressurized gas inside the gas canister 30. This may occur for example if a valve (not shown) along the length of the gas conduit 48 is shut and/or the gas canister 30 is not fully coupled to the gas conduit 48. One possible nonlimiting embodiment for the valving is described in co-pending U.S. patent application Ser. No. 18/060,893 to Riley. The projectile 12 is shown in a loaded position inside the firing chamber 14 ready to be fired out of the barrel 18. Because of the lack of positive pressure inside the compression chamber 40, the return spring 44 urges the firing piston 42 all the way rearwardly such that the radial collar 78 engages a corresponding collar surrounding the rear end of the compression chamber 40. In this uncompressed state, the radial collar 78 is spaced rearwardly from the catch on the sear of the release mechanism 46.

In FIG. 4, the firing mechanism 28 is shown in a cocked condition in which the interior of the compression chamber 40 is pressurized by a charge of compressed gas received from the gas canister 30 via the gas conduit 48, and the firing mechanism 28 is ready to fire the projectile 12 out of the muzzle of the barrel 18. The check valve 56 allows the compressed gas to enter the compression chamber 40 from the gas conduit 48 and prevents the compressed gas from returning into the gas conduit 48 from the compression chamber 40. In this pressurized state, the gas pressure inside the compression chamber 40 acting against the rear end of the plunger 64 forces the firing piston 42 forward toward the firing chamber 14 (to the left as seen in the drawings) until the radial collar 78 engages the catch on the sear of the release mechanism 46 in the retracted position. In this cocked condition, the front wall 62 of the firing piston 42 preferably is in engagement with or extremely close to the projectile 12. In the cocked condition, a valve (not shown) optionally may close the gas conduit 48 after the charge of compressed gas has been routed into the compression chamber 40 so as to prevent additional compressed gas into the compression chamber 40 until after the firing mechanism 28 is cycled ("fired"). Once cocked, the air gun 10 can be fired by pulling the finger trigger 26 rearwardly toward the grip 24, which causes the linkage 84 to rotate the sear of the release mechanism 46 downwardly to disengage the catch of the sear from the radial collar 78 of the firing piston 42. With the release mechanism 46 thus shifted to its disengaged position from the firing piston 42, the gas pressure inside the compression chamber 40 is able to slide the firing piston 42 forwardly into and through the firing chamber 14 (to the left as seen in the drawings) toward the breach end 32 of the barrel 18, thereby also forcefully pushing the projectile 12 into the breach end of the barrel 18.

Figure 6:
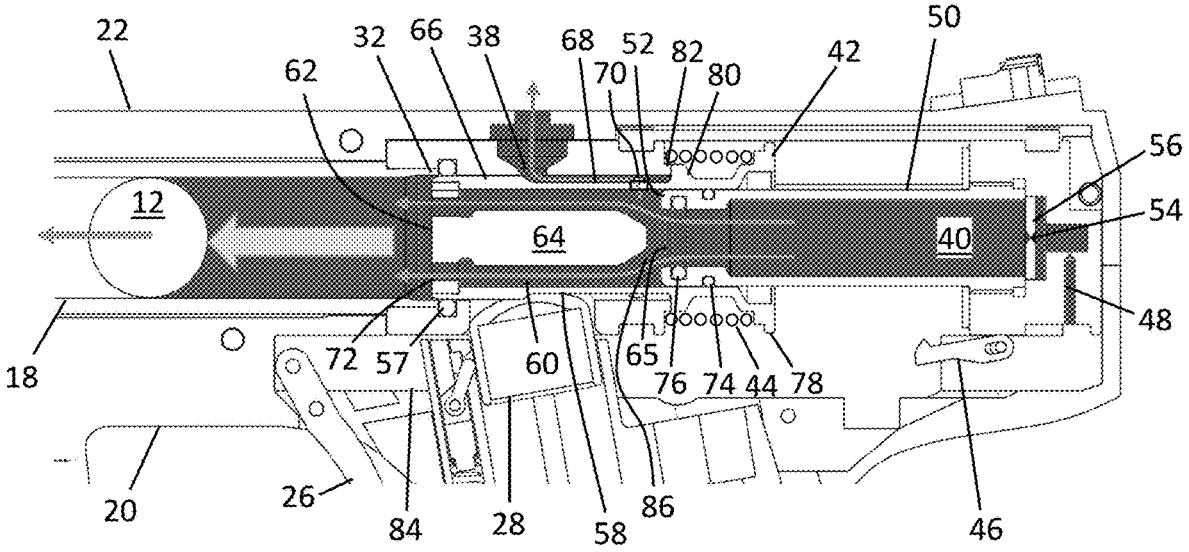
FIG. 6 is another axial cross-sectional view of the air gun with the firing piston in a fully extended position adjacent the breach end of the barrel.

FIG. 5 illustrates the firing mechanism 28 with the firing piston 42 in an intermediate position between the retracted position of FIG. 4 and the fully extended position of FIG. 6 after the release mechanism 46 has been disengaged. In this intermediate position, the pressurized gas pushes the firing piston 42 downrange (toward the muzzle end of the barrel 18) and the compressed gas flows into the firing chamber 14 to propel the projectile 12 out of barrel 18. Gas can flow into the inner chamber 60 and the firing chamber 14, but not out of vent aperture 38. To accomplish this, the piston head 66 seals the vent aperture 38 when the piston head 66 is axially aligned with the vent aperture 38. The plunger 64 has moved forward sufficiently to create a gap 86 between the plunger 64 and the opening 65 through the front end wall 52. In this example, the gap 86 is a radial gap formed, at least initially, by a chamfer at the rear end of the plunger 64. The pressurized gas inside the compression chamber 40 can escape through the gap 86 into the inner chamber 60 of the firing piston 42, and from there can flow through the second aperture(s) 72 into the space in the firing chamber 14 and/or barrel 18 between the front end wall 52 of the firing piston 42 and the rear surface of the projectile 12. Thus, the pressurized gas escaping from the compression chamber 40 through the inner chamber 60 into the firing chamber 14 and/or barrel 18 provides additional force against the projectile 12 to eject the projectile 12 out the front end of the barrel 18. In this intermediate position, the first aperture 70 is still axially aligned with the outer wall of the compression chamber 40 such that the compressed air inside the forward portion of the inner chamber 60 cannot yet escape through the first aperture 70. The downrange movement of the firing cylinder 42 also begins compressing the return spring 44.

The firing piston 42 then continues to travel downrange past the intermediate position of FIG. 5 to its maximum travel in the extended position shown in FIG. 6. The compressed gas flows into the firing chamber 14 and propels the projectile 12 out the front end of the barrel 18, and compressed gas inside the firing piston 42 is vented to atmosphere. FIG. 6 illustrates the firing mechanism 28 with the firing piston 42 in its fully extended position with the first stop member 80 engaged against the second stop member 82. In the extended position, the first aperture 70 is now displaced axially forward of the front end of the compression chamber 40 such that the compressed air inside the inner chamber 60 of the firing piston 42 also can escape the inner chamber 60 through the first aperture 70. In addition, the piston head 66 is disposed axially forward of the vent aperture 38 and the recessed groove 68 is aligned with the vent aperture 38. In this position, compressed air escaping through the first aperture 70 can flow along the recessed groove 68 into the vent aperture 38 and out to atmosphere. Thus, in the extended position, the compressed gas escapes not only forwardly through the barrel 18, but also laterally (e.g., radially) through the vent aperture 38, enabling the charge of compressed gas to be fully evacuated more quickly from the compression chamber 40 and the inner chamber 60 of the firing piston 42 than if the compressed gas could only exhaust through the barrel 18, thereby providing for faster cycling of the firing piston 42. However, because the vent aperture 38 is only fluidly/pneumatically connected with the inner chamber 60 at or near the very end of the forward travel portion of the cycle and after the compressed air has pressurized the space immediately behind the projectile 12, the loss of pressure on the projectile 12 is reduced, and thus ultimately improves the barrel exit velocity of the projectile 12.

After the projectile 12 has exited the muzzle (front end) of the barrel 18 and the compressed gas has exhausted sufficiently through the vent aperture 38 and the muzzle, the return spring 44 is then able to urge the firing piston 42 axially rearwardly back into the retracted position shown in FIG. 4. When the firing piston 42 has returned to the retracted position, the loading opening 36 is again exposed and a new projectile 12 automatically can be pushed laterally (upwardly as shown in the drawings) into the firing chamber 14, thereby automatically-reloading the air gun 10. Preferably, when the firing piston 42 cycles back into the retracted position, the release mechanism 46 automatically re-engages with the radial collar 78, and the compression chamber 40 is automatically repressurized with a new charge of compressed gas, for example, by a suitable valving mechanism along the gas conduit 48. The air gun 10 is then again in the cocked position and ready to be fired once again.

An advantageous feature of the present invention preferably includes the elimination of barrel cycling to load the next round. Such barrel cycling is typically intentional with conventional designs and results from gas (e.g., air or carbon dioxide) "blowback," but it often leads to less accurate shooting. Was described herein, preferably only the piston 42 cycles and loads the next projectile 12, and the vent aperture 38 and return spring 44 enable the piston 42 to fully cycle.

Various beneficial characteristics may be achieved by various embodiments of the air gun 10. In some embodiments, the fixed barrel 18 provides greater accuracy, and the automatic reloading function is performed by the firing piston 42 that is cycled using the compressed gas in conjunction with the return spring 44. The vent aperture 38 in some configurations can function as both a vent hole and as a loaded chamber indicator. Once the firing piston 42 travels fully down range the extended position, the compressed gas is vented through both the vent aperture 38 and the barrel 18. The vent aperture 38 allows the remaining gas pressure behind the firing piston 42 to be released to atmosphere, allowing the return spring 44 to act and return the piston 42 to the initial at rest position with reduced or no blow-back toward the user.

As previously noted above, though the foregoing detailed description describes certain aspects of one or more particular embodiments of the invention, alternatives could be adopted by one skilled in the art. For example, the air gun and its components could differ in appearance and construction from the embodiments described herein and shown in the drawings, functions of certain components of the air gun could be performed by components of different construction but capable of a similar (though not necessarily equivalent) function, and various materials could be used in the fabrication of the air gun and/or its components. As such, and again as was previously noted, it should be understood that the invention is not necessarily limited to any particular embodiment described herein or illustrated in the drawings.

The invention claimed is:

1. An automatically-reloading air gun comprising:

a frame;

a firing chamber disposed in the frame to receive a projectile;

a firing piston slidably carried by the frame and disposed at a rear end of the firing chamber;

a release mechanism shiftable between an engaged position that retains the firing piston in a retracted position behind the firing chamber and a disengaged position that allows the firing piston to move forwardly into the firing chamber to an extended position;

a return spring that urges the firing piston toward the retracted position;

a barrel fixedly carried by the frame at a front end of the firing chamber; and a vent aperture through the frame and in fluid communication with the firing chamber;

wherein actuation of the release mechanism from the engaged position to the disengaged position allows a charge of compressed gas behind the firing piston to slide the firing piston forward into the firing chamber to force a projectile in the firing chamber into the barrel;

wherein the compressed gas can exhaust out of the vent aperture from the firing chamber when the firing piston is in the extended position; and wherein the return spring slides the firing piston rearwardly to the retracted position after the compressed gas has exhausted from the firing chamber to automatically reload a new projectile into the firing chamber.

2. The automatically-reloading air gun of claim 1, wherein the firing chamber is visible through the vent aperture such that a user can visually verify whether a projectile is in the chamber.

3. The automatically-reloading air gun of claim 1, further comprising:

a magazine configured to provide a supply of new projectiles; and a loading opening into the firing chamber, the loading opening extending laterally into the firing chamber and connecting the magazine with the firing chamber such that at most one new projectile can be urged from the magazine laterally into the chamber when the firing piston is in the retracted position.

4. The automatically-reloading air gun of claim 1, wherein the firing piston prevents the compressed air from entering the firing chamber when in the retracted position and prevents the compressed air from escaping through the vent aperture when the firing piston is in an intermediate position between the retracted position and the extended position.

5. The automatically-reloading air gun of claim 4, wherein the firing piston comprises a peripheral piston wall defining an inner chamber disposed behind a front wall, wherein the inner chamber receives the compressed gas in the retracted position, the peripheral piston wall having an aperture therethrough, wherein the aperture is in fluid communication with the vent aperture when the piston is in the extended position and not in fluid communication with the vent aperture when the firing piston is in either of the intermediate position and the retracted position.

6. The automatically-reloading air gun of claim 5, wherein the firing piston allows the compressed air to enter the firing chamber when the firing piston is in the intermediate position.

7. The automatically-reloading air gun of claim 6, wherein the firing piston comprises a second aperture through the front wall that allows the compressed air to enter the firing chamber.

8. The automatically-reloading air gun of claim 7, further comprising:

a compression chamber behind the firing chamber, the compression chamber at least partly defined by a peripheral chamber wall fixedly coupled with the frame, an end wall, and an inlet configured to be fluidly coupled with a source of compressed gas;

wherein the compression chamber is disposed inside the inner chamber of the firing piston, wherein the firing piston slides between the retracted position and the extended position along the peripheral chamber wall, wherein the firing piston comprises a plunger extending rearwardly from the front wall through an opening in the end wall and into the compression chamber in the retracted position, wherein the plunger slidably seals the opening in the end wall in the retracted position to prevent the compressed air inside the compression chamber from escaping the compression chamber, and wherein the plunger does not seal the opening in the end wall in the extended position such that the compressed air can exhaust out of the compression chamber through the opening.

9. The automatically-reloading air gun of claim 8, wherein the plunger does not seal the opening in the end wall in the intermediate position such that the compressed air can exhaust out of the compression chamber through the opening and into the firing chamber through the second aperture in the front wall of the firing piston.

10. The automatically-reloading air gun of claim 9, wherein the peripheral piston wall comprises a piston head adjacent the firing chamber that forms a sliding seal with an interior wall of the firing chamber and a recessed groove rearward of the piston head on a radially outer surface of the peripheral piston wall that does not form a seal with the interior wall of the firing chamber, wherein the aperture through the peripheral piston wall is disposed in the recessed groove, wherein the piston head seals the vent aperture when the firing piston is in the intermediate position, and wherein the groove is fluidly coupled with the vent aperture when the firing piston is in the extended position, whereby the compressed air can exhaust through the vent aperture when the firing piston is in the extended position and the compressed air cannot exhaust through the vent aperture when the firing piston is in either of the intermediate position or the retracted position.

11. The automatically-reloading air gun of claim 10, further comprising a first stop member disposed on the radially outer periphery of the peripheral piston wall, wherein the stop member engages a second stop member fixed relative to the frame when the firing piston is in the extended position to prevent the firing piston from sliding forward beyond the extended position.

12. The automatically-reloading air gun of claim 5, wherein the firing piston allows the compressed air to enter the firing chamber when the firing piston is in the extended position.

13. A method of firing the automatically-reloading air gun of claim 1, the method comprising:

providing a charge of compressed gas behind the firing piston;

shifting the release mechanism from the engaged position to the disengaged position to allow the charge of compressed air to force the firing piston forward into the firing chamber without sliding the barrel relative to the frame;

exhausting at least a portion of the compressed air from the firing chamber through the vent aperture when the firing piston is disposed in the extended position; and sliding the firing piston rearwardly to the retracted position with the return spring after at least the portion of the compressed air exhausts through the vent aperture.

14. A method of using the automatically-reloading air gun of claim 1, the method comprising:

visually determining if a projectile is disposed in the firing chamber by looking through the vent aperture.

* * * * *